US005249938A

United States Patent [19]

Hall

[11] Patent Number: 5,249,938

[45] Date of Patent: Oct. 5, 1993

[54] PERISTALTIC PUMP

[75] Inventor: Richard C. Hall, Abingdon, United Kingdom

[73] Assignee: Bellhouse Technology Limited, Abingdon, United Kingdom

[21] Appl. No.: 777,565

[22] PCT Filed: Jun. 5, 1990

[86] PCT No.: PCT/GB90/00873

§ 371 Date: Jan. 10, 1992

§ 102(e) Date: Jan. 10, 1992

[87] PCT Pub. No.: WO90/15248

PCT Pub. Date: Dec. 13, 1990

[30] Foreign Application Priority Data

Jun. 6, 1989 [GB] United Kingdom ..... 8912946

[51] Int. Cl.[5] ..... F04B 43/12

[52] U.S. Cl. ..... 417/477; 417/476

[58] Field of Search ..... 417/474, 478

[56] References Cited

U.S. PATENT DOCUMENTS

| | | | |
|---|---|---|---|
| 2,794,400 | 6/1957 | Bodine | 417/477 |
| 3,180,272 | 4/1965 | Broadfoot | 417/477 |
| 4,500,269 | 2/1985 | Jess | 417/476 |
| 4,527,323 | 7/1985 | Dawson | 417/477 |
| 4,545,744 | 10/1985 | Weber et al. | 417/475 |
| 4,702,679 | 10/1987 | Malbec | 417/475 |
| 4,824,339 | 4/1989 | Bainbridge | 417/477 |
| 4,861,242 | 8/1989 | Finsterwald | 417/476 |
| 4,909,713 | 3/1990 | Finsterwald | 417/477 |

FOREIGN PATENT DOCUMENTS

| | | |
|---|---|---|
| 2162998 | 6/1973 | Fed. Rep. of Germany . |
| 2619603 | 2/1989 | France . |
| 213680 | 6/1941 | Switzerland . |

*Primary Examiner*—Richard A. Bertsch
*Assistant Examiner*—Peter Koryinyk
*Attorney, Agent, or Firm*—Baker & Daniels

[57] ABSTRACT

A peristaltic pump has an occluder ring (1) and a rotor (5) with drive rollers (16,17) for squeezing a flexible pipe (11) against the ring (1). The rotor has dogs (12a,12b) for overriding a bight of the pipe to load it through a gap (10) between a cover plate (8) of the rotor and the ring (1).

16 Claims, 2 Drawing Sheets

PERISTALTIC PUMP

BACKGROUND OF THE INVENTION

When peristaltic roller pumps are used, for example, for pumping blood, the blood pipe may suffer damage caused by the pipe being squeezed and twisted as it is loaded and unloaded into and out of the pumphead. This damage may cause the contamination or loss of the blood being pumped, as well as the destruction of the pipe.

Accordingly, a pumphead has been sought which enables easy loading and unloading of a pipe into the pumphead with the minimum amount of stress being brought to bear on the pipe, but which exerts the minimum necessary amount of force on the pipe during pumping.

SUMMARY OF THE INVENTION

According to the present invention, a head for a peristaltic roller pump comprises an occluder ring, having a pair of substantially tangential slots opening at an axial end of the ring to enable a flexible pipe to enter, lie around the inner wall surface of, and exit from, the ring; and a rotor concentrically and rotatably mounted within the occluder ring, the rotor having a circumferential array of guide and drive rollers respectively for locating the pipe axially within the ring and for squeezing the pipe against the inner wall surface of the occluder ring, the rotor also having a cover plate radially inwardly spaced from the inner wall surface of the occluder ring to provide a part annular gap of sufficient width for loading and unloading of the pipe into and out of the ring, the gap being substantially closed at at least one end by a radially outwardly projecting dog on the rotor, and the arrangement being such that the pipe can be loaded into the ring by placing a bight of the pipe in one of the slots and rotating the rotor so that the dog overrides the pipe and pushes it axially through the gap into the ring.

In use, the pipe may be held in position at both ends of the loop of pipe which extends through the ring by clamps which, along with the precise compression of the pipe by the drive rollers, prevent the pipe from creeping around the occluder ring.

The gap left between the cover plate of the rotor and the inner wall surface of the occluder ring gives the advantage that the pipe may be visually observed during pumping and any damage to the pipe can be spotted quickly and further damage can be prevented.

Preferably the dog is circumferentially positioned adjacent to, but ahead in the direction in which the dog faces, of one of the rollers and the part annular gap extends at least to the next roller positioned circumferentially around the rotor in the direction in which the dog faces. The pipe can then drop easily into the gap without being deformed excessively, but using its own natural tendency to unbend as the primary force moving it through the gap into the ring. Another advantage of this arrangement, if the dog is positioned adjacent to a guide roller, is that the entry and axial location of the pipe happen in quick succession, thus preventing the pipe from becoming snared in some part of the rotor mechanism.

The pumphead may be used with both disposable and re-usable pipes. In the case of re-usable pipes, where it is important that the pipes are not damaged on unloading, the dog may be used to underride the pipe loop and lift it out of the occluder ring through the gap. This will involve rotating the rotor in the same direction as on loading the pipe. However the pumphead may have a second dog facing in the opposite circumferential direction to the first. This may be used for underriding the pipe when the pipe is to be unloaded from the ring, upon rotation of the rotor in the opposite direction to that for loading with the first dog. Also, with this arrangement of two dogs, the pumphead offers the further, important advantage that the pipe may be loaded and unloaded in either a clockwise or anticlockwise direction, making the equipment easy to use and ergonomically efficient. The two dogs may be provided by the opposite ends of a common dog element which extends only a short angular distance around the ring.

Preferably, the pumphead consists of four equiangularly spaced rollers of which one diametrically opposite pair are drive rollers and the other diametrically opposite pair are guide rollers. This arrangement, presenting a minimum number of drive rollers, ensures a minimum amount of blood damage during pumping.

It is preferable if the guide rollers have peripheral surfaces which are substantially V-shaped in axial section. In this form, the guide rollers can maintain the pipe substantially in a position midway along the axial length of the occluder ring.

The drive rollers are preferably cylindrical and surface compliance is provided by hard rubber tires.

BRIEF DESCRIPTION OF THE DRAWINGS

The invention will now be described with reference to the accompanying drawings, in which.

DESCRIPTION OF THE PREFERRED EMBODIMENT

Figure 2:
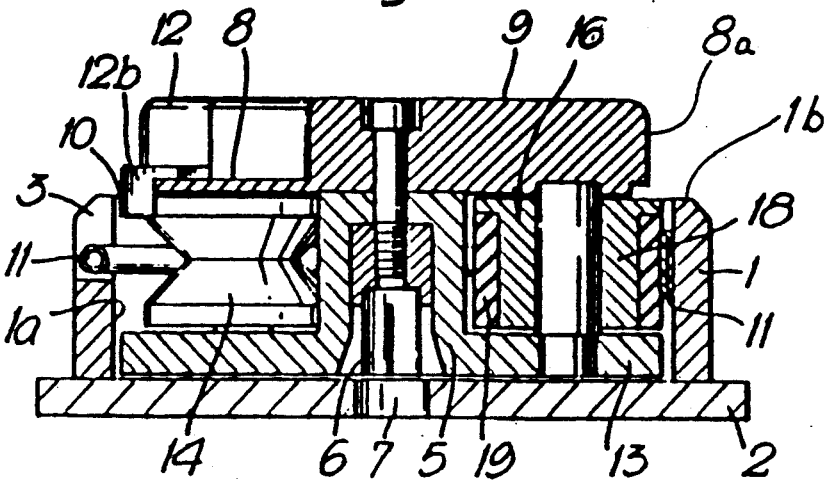
FIG. 2 is a section taken on the line X—X of FIG. 1.

The illustrated pumphead has a metallic occluder ring 1, with a cylindrical internal working surface Ia, fixed to a back plate 2 of the pump. The occluder ring has two slots 3, 4, which open substantially tangentially to an inner wall surface Ia of the and are cut to substantially half the axial depth of the occluder ring. Mounted concentrically within the occluder ring is a metallic rotor 5, which has a bush 6 for receiving a drive shaft of a motor, which shaft will extend through an opening 7 in the back plate. The rotor 5 has a metallic cover plate 8, formed integrally with cruciform shaped ribs 9 for manual rotation of the rotor. As best seen in FIG. 2, the cover plate 8 is axially positioned substantially level with an end edge 1*b* the occluder ring 1, and such that an edge 8*a* of the cover plate 8 is radially inwardly spaced from the inner wall surface la of the occluder ring 1 forming a gap 10 that is part annular (i.e., that does not fully extend about the circumference of cover plate 8). having a width a little greater than the outer diameter of a flexible translucent plastics pipe 11 to be laid into the gap 10. Attached to the cover plate 8 by an adhesive bond, is a plastics dual dog element 12 having oppositely circumferentially facing dogs 12*a*, 12*b* formed on the end, thereof which overlie, and extend downwardly into, the gap 10.

The rotor 5 has an equiangularly spaced circumferential array of four rollers rotatably mounted on axles between a base 13 and the cover plate 8 of the rotor 5. Of these rollers, one diametrically opposite pair are guide rollers 14, 15 having substantially V-shaped axial sections and made from a plastics material. The dog element 12 is situated directly over the roller 14. The other diametrically opposite pair of rollers are drive rollers 16, 17 having metal hubs and cylindrical vulcanised rubber tires or surface 19.

Figure 1:
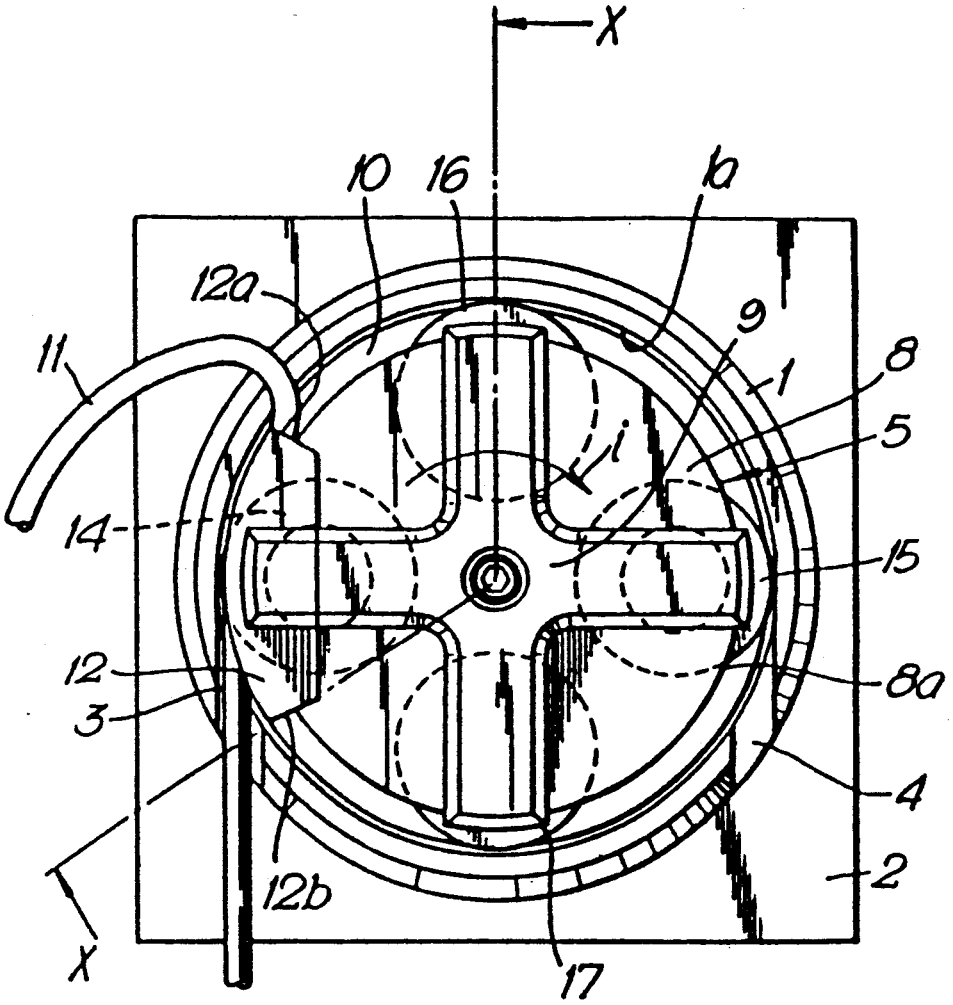
FIG. 1 is a front elevation of a peristaltic pumphead in accordance with the invention.
Figure 3:
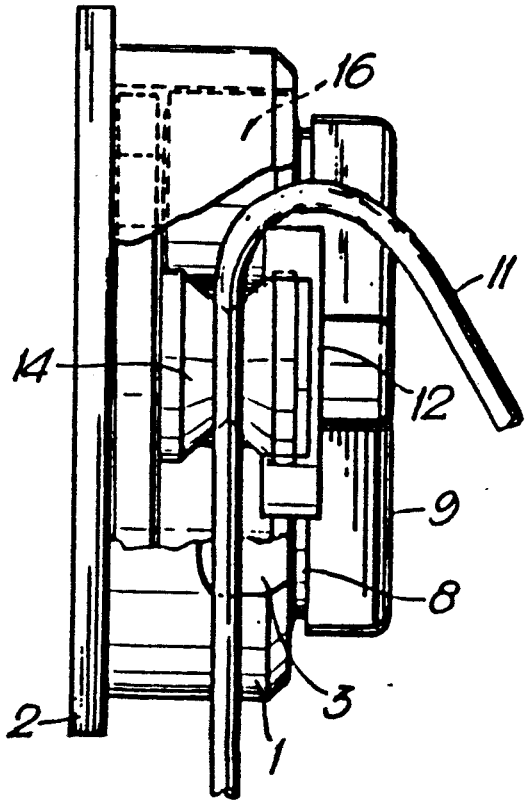
FIG. 3 is a part cutaway view showing the loading of the pipe.

In operation, the pipe may be loaded into the pumphead in the following manner. As shown in FIGS. 1 and 3, a bight of the pipe 11 is placed in one of the slots 3, 4 and the rotor 8 is rotated manually using the ribs 9 to bring the dog 12*a* to override the pipe. On further rotation of the rotor 8 the dog 12*a* pushes the pipe axially through the gap 10 by engagement with the pipe.

The radial position of each dog 12*a*, 12*b* and the neighbouring drive roller allows the natural tendency of the pipe to unbend to act as the primary force moving it axially through the gap 10 into the ring 1. In this way, the pipe is not deformed excessively during loading and thus the risk of damage is substantially reduced. As the pipe II is encouraged through the gap 10 the guide roller 14 acts to guide the pipe 11, to a position substantially axially midway in the occluder ring 1. Manual rotation of the rotor continues until the pipe 11 exits the occluder ring 1 through the other slot 4. The pipe may then be clamped at each end of the loop of the pipe running through the pumphead, in order to hold the pipe in position during pumping, and loading is thus completed.

The pipe is shown being loaded by rotation of the rotor in a clockwise direction, designated by arrow i. In this case, the dog 12*a* engages the pipe. It should be noted, however, that loading of the pipe 11 may be carried out by rotation of the rotor 8 in an anti-clockwise direction, by placing the bight of pipe in the slot 4 and using the other dog 12*b*.

For unloading of the pipe, the pipe is first unclamped and a section of the pipe at one of the slots 3, 4 is lifted and the rotor rotated to bring a dog 12*a* or 12*a* around to underride the pipe. Continued rotation of the rotor 5 causes the dog 12*a* or 12*a* to lift the pipe axially out through the gap 10 until the pipe is finally lifted out of the other slot.

The pump is operated in the usual way, by rotation of the rotor by the motor so that the drive rollers 16, 17 sequentially squeeze the pipe closed, as seen in FIG. 2, and force liquid through the pipe ahead of them. As the drive rollers are spaced by 180° and the angle through which the pipe 11 extends around the occluder ring between the slots 3, 4 is greater than 180° , there will always be a volume of liquid trapped in the pipe between the two drive rollers.

I claim:

1. A head for a peristaltic roller pump, the head comprising an occluder ring having a pair of substantially tangential slots opening at an axial end of the ring to enable a flexible pipe to enter, lie around the inner wall surface of, and exit from, the ring; and a rotor concentrically and rotatably mounted within the occluder ring, the rotor having a circumferential array of guide and drive rollers respectively for locating the pipe axially within the ring and for squeezing the pipe against the inner wall surface of the occluder ring, the rotor also having a cover plate radially inwardly spaced from the inner wall surface of the occluder ring to provide a part annular gap of sufficient width for loading and unloading of the pipe into and out of the ring, the gap being substantially closed at at least one end by a radially outwardly projecting first dog on the rotor, a said guide roller immediately trailing said dog in its direction of rotation and the arrangement being such that the pipe can be loaded into the ring by placing a bight of the pipe in one of the slots and rotating the rotor so that the dog overrides the pipe and pushes it axially through the gap into the ring where the trailing guide roller immediately captures the pipe.

2. A pumphead according to claim 1, in which the dog is circumferentially positioned adjacent to, but ahead in the direction in which the dog faces, of one of the rollers and the part annular gap extends at least to the next roller positioned circumferentially around the rotor in the direction in which the dog faces.

3. A pumphead according to claim 2, which has a second dog facing in the opposite circumferential direction to the first dog for overriding the pipe when the pipe is to be unloaded from the ring, upon rotation of the rotor in the opposite direction to that for loading with the first dog.

4. A pumphead according to claim 3, which consists of four equiangularly spaced rollers of which one diametrically opposite pair are drive rollers and the other diametrically opposite pair are guide rollers.

5. A pumphead according to claim 3, in which the guide rollers have peripheral surfaces which are substantially V-shaped in axial section.

6. A pumphead to claim 3, in which the drive rollers are cylindrical and surface compliance is provided by hard rubber surfaces thereon.

7. A pumphead according to claim 2, which consists of four equiangularly spaced rollers of which one diametrically opposite pair are drive rollers and the other diametrically opposite pair are guide rollers.

8. A pump according to claim 2, in which the guide rollers have peripheral surfaces which are substantially V-shaped in axial section.

9. A pumphead according to claim 2, in which the drive rollers are cylindrical and surface compliance is provided by hard rubber surfaces thereon.

10. A pumphead according to claim 1 which consists of four equiangularly spaced rollers of which one diametrically opposite pair are drive rollers and the other diametrically opposite pair are guide rollers.

11. A pumphead according to claim 10, in which the guide rollers have peripheral surfaces which are substantially V-shaped in axial section.

12. A pumphead according to claim 10, in which the drive rollers are cylindrical and surface compliance is provided by hard rubber surfaces thereon.

13. A pumphead according to claim 1, in which the guide rollers have peripheral surfaces which are substantially V-shaped in axial section.

14. A pumphead according to claim 13, in which the drive rollers are cylindrical and surface compliance is provided by hard rubber surfaces thereon.

15. A pumphead according to claim 1, in which the drive rollers are cylindrical and surface compliance is provided by hard rubber surfaces thereon.

16. A head for a peristaltic roller pump, the head comprising an occluder ring having a pair of substantially tangential slots opening at an axial end of the ring to enable a flexible pipe to enter, lie around the inner wall surface of, and exit from, the ring; and a rotor concentrically and rotatably mounted within the occluder ring, the rotor having a circumferential array of guide and drive rollers respectively for locating the pipe axially within the ring and for squeezing the pipe against the inner wall surface of the occluder ring, the rotor also having a cover plate radially inwardly spaced from the inner wall surface of the occluder ring to provide a part annular gap of sufficient width for loading and unloading of the pipe into and out of the ring, the gap being substantially closed at at least one end by a radially outwardly projecting dual dog element on the rotor, said dog element having a first dog facing in a first circumferential direction and a second dog facing in the opposite circumferential direction, said guide roller located between said dogs whereby the pipe can be loaded into the ring by placing a bight of the pipe in one of the slots and rotating the rotor in either direction so that said dog facing in the direction of rotation of the rotor overrides the pipe and pushes it axially through the tap into the ring where the trailing guide roller immediately captures the pipe.

* * * * *